US012747924B1

(12) United States Patent
Rago

(10) Patent No.: US 12,747,924 B1
(45) Date of Patent: Sep. 29, 2026

(54) SECTIONED REDUCING BARREL SYSTEM AND METHOD OF USE

(71) Applicant: Scott Barrett Rago, Nacogdoches, TX (US)

(72) Inventor: Scott Barrett Rago, Nacogdoches, TX (US)

( * ) Notice: Subject to any disclaimer, the term of this patent is extended or adjusted under 35 U.S.C. 154(b) by 0 days.

(21) Appl. No.: 19/311,151

(22) Filed: Aug. 27, 2025

Related U.S. Application Data

(63) Continuation of application No. 19/240,296, filed on Jun. 17, 2025, now abandoned.

(60) Provisional application No. 63/750,607, filed on Jan. 28, 2025.

(51) Int. Cl.
*F41A 21/16* (2006.01)

(52) U.S. Cl.
CPC ..... *F41A 21/16* (2013.01)

(58) Field of Classification Search
CPC ..... F41A 21/16
USPC ..... 42/76.01; 89/14.05, 14.5, 14.7
See application file for complete search history.

(56) References Cited

U.S. PATENT DOCUMENTS

| | | | | |
|---|---|---|---|---|
| 1,552,864 | A * | 9/1925 | Methlin | F41A 21/12 89/14.05 |
| 2,345,089 | A * | 3/1944 | Born | F41A 21/16 42/78 |
| 2,423,453 | A * | 7/1947 | Howe | F41A 21/16 89/14.6 |
| 3,450,050 | A | 6/1969 | Robinson | |
| 3,680,485 | A | 8/1972 | Zaid et al. | |
| 4,126,955 | A | 11/1978 | Coffield, Jr. et al. | |
| 4,527,348 | A * | 7/1985 | Brennan | F41A 21/28 89/14.05 |
| 4,660,312 | A | 4/1987 | A'Costa | |
| 11,473,883 | B1 * | 10/2022 | Sooter | F41A 21/18 |
| 2023/0152053 | A1 * | 5/2023 | Moretti | F41A 21/12 42/76.01 |

FOREIGN PATENT DOCUMENTS

| | | | |
|---|---|---|---|
| EP | 0218297 | A1 | 5/1990 |
| GB | 407323 | A | 3/1934 |
| WO | WO2023086759 | A1 | 5/2023 |

* cited by examiner

*Primary Examiner* — Bret Hayes
(74) *Attorney, Agent, or Firm* — Richard Eldredge; Leavitt Eldredge Law Firm

(57) ABSTRACT

A stepped, stabilized, sectioned reducing barrel for firearms is disclosed. The application enables the efficient use of standard cartridges by applying a series of bore sections that stabilize a projectile, reduce its diameter in a controlled manner, re-stabilize the shape, and finally impart rifling spin. This improves ballistic performance, reduces material usage, and extends barrel life without the need for specialized ammunition.

13 Claims, 2 Drawing Sheets

SECTIONED REDUCING BARREL SYSTEM AND METHOD OF USE

BACKGROUND

1. Field of the Invention

The present invention relates generally to internal ballistics and firearm barrel design, and more specifically a novel system for increasing propulsion efficiency and preserving projectile integrity by using a stepped stabilization and reduction process prior to rifling engagement

2. Description of Related Art

Modern firearms continue to evolve in projectile design, materials, and propellants, but firearm barrels themselves remain largely unchanged in functional design. Conventional firearm barrels feature a continuous bore diameter beyond the chamber, with rifling applied directly after the chamber to spin-stabilize the projectile. The performance enhancements in modern ammunition have largely focused on increasing the volume of propellant or modifying projectile materials and shapes, but not on optimizing how the pressure generated by propellant is utilized within the barrel itself.

Historically, rifle barrels that reduce bullet diameter to take advantage of pressure increases have existed most were not perfected due to material and manufacturing at that time. Previous types of reduction have been a violent process. Some, during reduction had rifling cut into the taper section causing a filing action in the barrel. Some have been an after-barrel attachment. Some have been a continues taper (not a sectioned process allowing stabilizing for the final diameter). No current technology fully addresses the inefficiencies arising from the uncontrolled nature of projectile acceleration and rifling engagement in a continuous bore system.

Accordingly, it is an object of the present application to provide a stepped stabilized sectioned reducing barrel system and method of use that addresses the above-mentioned concerns.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
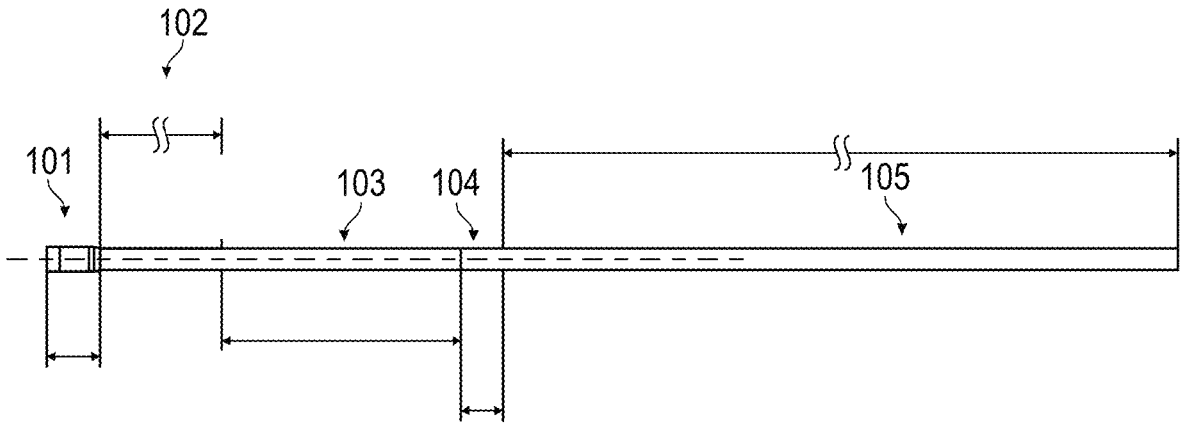
FIG. 1 is a simplified cross-sectional view of a firearm in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION

Illustrative cases of the system and method of use of the present application are provided below. It will of course be appreciated that in the development of any actual case, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several cases of the system are presented herein. It should be understood that various components, parts, and features of the different cases may be combined together and/or interchanged with one another, all of which are within the scope of the present application, even though not all variations and particular cases are shown in the drawings. It should also be understood that the mixing and matching of features, elements, and/or functions between various cases is expressly contemplated herein so that one of ordinary skill in the art would appreciate from this disclosure that the features, elements, and/or functions of one case may be incorporated into another case as appropriate, unless described otherwise.

Figure 2:
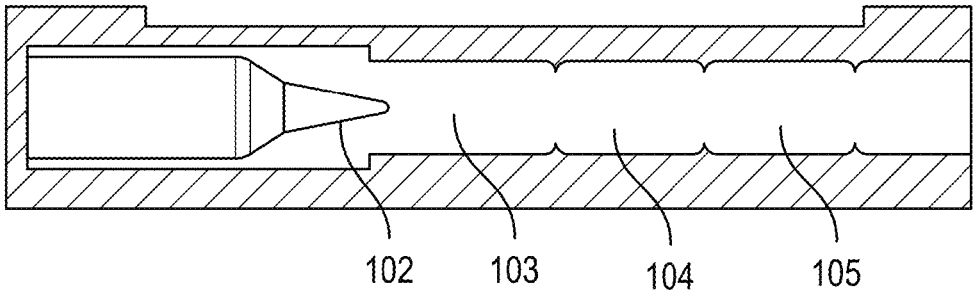
FIG. 2 is a cross-sectional view of the barrel of the firearm of FIG. 1.
Figure 3:
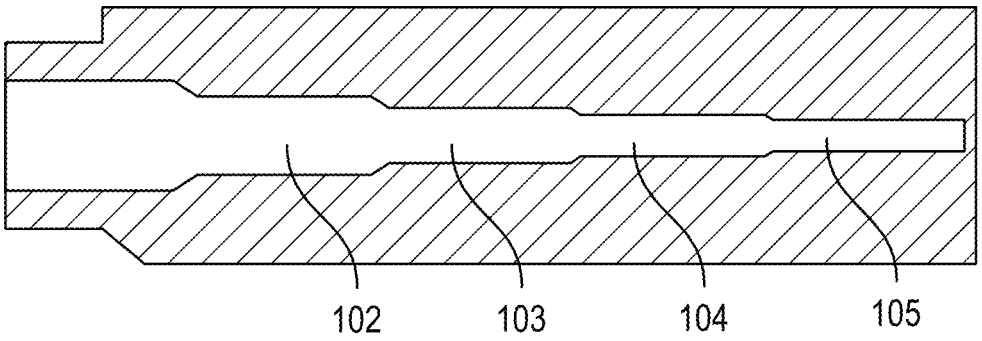
FIG. 3 is a schematic view of the sectioned reducing barrel system in a preferred embodiment of the present application.

The preferred case herein described is not intended to be exhaustive or to limit the invention to the precise form disclosed. It is chosen and described to explain the principles of the invention and its application and practical use to enable others skilled in the art to follow its teachings The technology described herein fulfills a stepped stabilized sectioned reducing barrel system that enables efficient use of standard cartridges by manipulating barrel geometry to increase internal pressure through controlled projectile diameter reduction 100 as shown in FIGS. 1-3.

In the contemplated embodiment, the cartridge is seated in the chamber section 101. Upon ignition, due to pressure increases from the propellent burning, drives the round or bullet forward through the throat into a stabilization section 102.

In the contemplated embodiment, the first stabilization section 102 is a smooth section that allows the round or bullet to engage in the barrel and seal the propellent gases behind it. Stabilizing the round in barrel with even contact around the diameter is needed to prep the bullet for even diameter reduction. No rifling or twist is present to prevent damage during this high-pressure phase.

In the contemplated embodiment, the next section is a reduction section 103. The reduction section is a smooth taper to reduce the outer diameter of the projectile allowing for gas pressure increases. The length and ratio of reduction are standardized based on bullet caliber and material properties. This process raises internal pressure, increasing velocity and performance.

In the contemplated embodiment, once the projectile reaches its final reduced diameter, it enters a second stabilization section 104. This section is smooth and no greater than that of the depth of rifling that is yet to be applied. This section is a standardized length for the given bullet of approximate length and/or amount of material. The bullet is fully stabilized in this section at its final diameter prior to rifling. This section supports and centers the full length of the projectile's bearing surface, maintaining integrity and preparing it for rifling.

In the contemplated embodiment, after final stabilization, the next section 105 rifling is applied to the barrel allowing the bullet to gain its needed twist rate for in flight stabilization. It is to be noted, there is no specialization of the rifling, type of rifling, or rifling ratio needed. Standard modern principles may be applied to this section.

It is also to be noted that the features described above applies to the internal design of the barrels. The exterior of the barrel can be anything needed to meet demands of performance or attachment. Referring now to FIG. 2, the different sections of the barrel are shown having reduced diameters. For example, the diameter of section 102 is greater than the diameter of section 103, which in turn is greater than the diameters of sections 104 and 105.

The present application has additional benefits such as efficient use of all materials to create a higher level of performance, less need for manufacturing steps in a cartridge for higher performance, and lower costs of materials needed of for the higher level of performance.

The present application allows for the use of standard cartridges without damaging the bearing surface or material integrity all while having the ability to work with modern manufacturing restrictions and also has the ability to adapt to current technology and future technology.

The particular cases disclosed above are illustrative only, as the cases may be modified and practiced in different but equivalent manners apparent to those skilled in the art having the benefit of the teachings herein. It is therefore evident that the particular cases disclosed above may be altered or modified, and all such variations are considered within the scope and spirit of the application. Accordingly, the protection sought herein is as set forth in the description. Although the present cases are shown above, they are not limited to just these cases but are amenable to various changes and modifications without departing from the spirit thereof.

What is claimed is:

1. A firearm barrel, comprising:

a chamber configured for receiving a cartridge;

a first internal bore section configured to stabilize a projectile without rifling;

a second internal bore section configured with a tapered or stepped diameter reduction to reduce the diameter of the projectile by deforming the projectile through compressive radial force applied by the bore wall;

a third internal bore section configured to stabilize the projectile at the reduced diameter without rifling; and a fourth internal bore section having rifling configured to impart spin to the projectile after stabilization at the reduced diameter only after the projectile has been fully reduced in diameter and re-stabilized in the third internal bore section, such that no rifling engages the projectile prior to completion of diameter reduction.

2. The firearm barrel of claim 1, wherein a reduction ratio of the second internal bore section, defined as a ratio of an initial projectile diameter to a reduced projectile diameter, is within a predetermined range corresponding to a specific projectile caliber and projectile material type selected from lead, copper, or jacketed compositions.

3. The firearm barrel of claim 1, wherein the first and third internal bore sections are optionally smoot bore or include straight grooves.

4. The firearm barrel of claim 1, wherein the rifling in the fourth section is selected from a group consisting of conventional refiling having land and grooves with a constant twist rate or polygonal rifling having a continuous curved profile.

5. A method of firing a projectile through a firearm barrel comprising the steps of:

stabilizing the projectile in a smooth or a straight-grooved bore section;

reducing the projectile diameter through a controlled taper or a stepped bore section by plastically deforming the surface of the projectile via radial compression from the bore;

stabilizing the projectile again in a final bore section at reduced diameter; and engaging rifling to impart spin after full stabilization only after the projectile has exited the diameter-reducing section and achieved axial stability in the reduced diameter section.

6. The method of firing a projectile through a firearm barrel of claim 5, wherein each transition between sections is controlled to avoid material tearing or instability of the projectile by providing a transition profile having a continuous taper or discrete step angles selected to maintain projectile concentricity and structural integrity during diameter reduction.

7. A firearm barrel, comprising:

a chamber configured to receive a cartridge;

a diameter-reducing bore portion disposed downstream of the chamber and configured to plastically deform a projectile by applying a radially inward compressive force that reduces an outer diameter of the projectile without engagement of rifling;

a stabilization bore portion disposed downstream of the diameter-reducing bore portion and having a substantially constant inner diameter corresponding to the reduced outer diameter of the projectile, the stabilization bore portion being configured to axially align and re-center the projectile after plastic deformation; and a rifled bore portion disposed downstream of the stabilization bore portion and configured to impart rotational spin to the projectile, wherein the rifled bore portion is axially spaced from the diameter-reducing bore portion such that no portion of the projectile engages rifling until after the projectile exits the stabilization bore portion.

8. The firearm barrel of claim 7, wherein the diameter-reducing bore portion comprises a continuous taper having a taper angle selected to induce plastic deformation of the projectile without causing material fracture.

9. The firearm barrel of claim 7, wherein the diameter-reducing bore portion comprises a plurality of stepped diameter reductions separated by intermediate cylindrical sections configured to incrementally deform the projectile.

10. The firearm barrel of claim 7, wherein the stabilization bore portion has an axial length of at least three times the reduced diameter of the projectile to ensure dynamic stabilization prior to rifling engagement.

11. The firearm barrel of claim 7, wherein the rifled bore portion includes progressively increasing rifling engagement depth along an axial direction to gradually impart spin to the projectile.

12. The firearm barrel of claim 7, wherein the diameter-reducing bore portion is configured such that material flow of the projectile during deformation is predominantly radial and limited in axial elongation to less than 5% of an original projectile length.

13. The firearm barrel of claim 7, wherein the stabilization bore portion includes a smooth bore or straight longitudinal grooves configured to maintain projectile alignment without imparting rotational spin prior to rifling engagement.

* * * * *